US008177663B2

(12) United States Patent
Tucker, Sr. et al.

(10) Patent No.: US 8,177,663 B2
(45) Date of Patent: May 15, 2012

(54) GOLF CLUB WITH INTERCHANGEABLE FACES AND WEIGHTS

(75) Inventors: Richard B. C. Tucker, Sr., Ruxton, MD (US); George Tolen, Ellicott City, MD (US)

(73) Assignee: Wm. T. Burnett IP, LLP, Baltimore, MD (US)

( * ) Notice: Subject to any disclaimer, the term of this patent is extended or adjusted under 35 U.S.C. 154(b) by 179 days.

(21) Appl. No.: 12/508,342

(22) Filed: Jul. 23, 2009

(65) Prior Publication Data

US 2011/0021287 A1 Jan. 27, 2011

(51) Int. Cl.
*A63B 53/00* (2006.01)

(52) U.S. Cl. ..... 473/334; 473/325; 473/341; 473/342

(58) Field of Classification Search ..... 473/342, 473/334–341

See application file for complete search history.

(56) References Cited

U.S. PATENT DOCUMENTS

| | | | | |
|---|---|---|---|---|
| 1,253,700 | A | | 1/1918 | McLaughlin |
| 1,455,379 | A | | 5/1923 | Allen |
| 1,463,533 | A | | 7/1923 | Kurz, Jr. |
| 1,558,703 | A | | 10/1925 | Miller |
| 2,201,638 | A | | 5/1940 | Theibault |
| 2,530,446 | A | | 11/1950 | Beardsley |
| 3,211,455 | A | | 10/1965 | Hyden |
| 3,218,072 | A | | 11/1965 | Burr |
| 3,220,733 | A | | 11/1965 | Saleeby |
| 3,310,309 | A | | 3/1967 | Moss |
| 3,368,812 | A | | 2/1968 | Baldwin |
| 3,516,674 | A | * | 6/1970 | Scarborough ..... 473/311 |
| 3,937,474 | A | | 2/1976 | Jepson et al. |
| 4,121,832 | A | | 10/1978 | Ebbing |
| 4,195,842 | A | * | 4/1980 | Coleman ..... 473/337 |
| 4,325,553 | A | * | 4/1982 | Taylor ..... 473/337 |
| 4,422,638 | A | | 12/1983 | Tucker |
| 4,884,808 | A | | 12/1989 | Retzer |
| 4,884,812 | A | | 12/1989 | Nagasaki et al. |
| 5,332,214 | A | | 7/1994 | Tucker |
| 5,332,223 | A | | 7/1994 | Johnson |
| 5,346,213 | A | | 9/1994 | Yamada |
| 5,429,356 | A | * | 7/1995 | Dingle et al. ..... 473/251 |
| 5,437,447 | A | | 8/1995 | Rigutto |

(Continued)

FOREIGN PATENT DOCUMENTS

JP 6-165843 6/1994

*Primary Examiner* — Gene Kim
*Assistant Examiner* — Matthew B Stanczak
(74) *Attorney, Agent, or Firm* — Ober, Kaler, Grimes & Shriver; Royal W. Craig

(57) ABSTRACT

In accordance with the present invention, a golf putter and method of adjustment of the golf putter are provided. The golf putter includes two threaded connections, one between a weighting element and a putter head, and one between a screw fastener and a replaceable striking surface attachment. The weighting element may be attached to the putter head by manual manipulation. The striking surface attachment may be attached to the putter head by a magnetic connection or any other attachment means suitable for easy replacement during a practice or experimentation mode, and is further configured to be attached to a screw fastener using a tool such that the golf putter is in compliance with rules. The screw fastener passes through the weighting element so that it locks the weighting element simultaneously when affixing the striking surface attachment, thus rendering the weighting element non-removable without the use of a tool.

11 Claims, 4 Drawing Sheets

U.S. PATENT DOCUMENTS 5,439,222 A * 8/1995 Kranenberg ..... 473/309
5,458,332 A 10/1995 Fisher
D368,504 S * 4/1996 Sommerhauser ..... D21/734
5,531,439 A 7/1996 Azzarella
5,542,675 A 8/1996 Micciche et al.
5,571,053 A * 11/1996 Lane ..... 473/336
5,620,381 A 4/1997 Spalding
5,674,132 A 10/1997 Fisher
5,688,190 A 11/1997 Rowland et al.
5,690,561 A 11/1997 Rowland et al.
5,690,562 A 11/1997 Sturm
5,718,644 A 2/1998 Donofrio
5,746,664 A 5/1998 Reynolds
5,839,974 A 11/1998 McAllister
5,863,257 A * 1/1999 Busnardo ..... 473/246
5,899,817 A * 5/1999 Dunikoski ..... 473/314
5,921,871 A 7/1999 Fisher
5,924,938 A * 7/1999 Hines ..... 473/307
5,976,033 A 11/1999 Takeda
5,997,411 A 12/1999 Holub
6,001,024 A 12/1999 Van Alen, II et al.
6,001,030 A 12/1999 Delaney
6,022,280 A 2/2000 Arenburg et al.
6,102,813 A 8/2000 Dill
6,203,444 B1 3/2001 McRae
6,224,496 B1 5/2001 Rowland et al.
6,227,986 B1 5/2001 Fisher
6,238,303 B1 5/2001 Fite
6,270,423 B1 8/2001 Webb
6,296,574 B1 10/2001 Kaldis
6,428,423 B1 * 8/2002 Merko ..... 473/307
6,527,649 B1 * 3/2003 Neher et al. ..... 473/248
6,533,678 B1 3/2003 Johnson
6,863,620 B2 3/2005 Tucker, Sr.
7,101,290 B2 9/2006 Tucker, Sr.
7,121,956 B2 * 10/2006 Lo ..... 473/335
7,163,465 B2 1/2007 Edel
7,297,073 B2 * 11/2007 Jung ..... 473/340
D565,138 S * 3/2008 Wilson ..... D21/743
7,563,172 B2 7/2009 Mansfield
7,611,425 B2 * 11/2009 Yeh ..... 473/337
7,744,484 B1 * 6/2010 Chao ..... 473/324
7,785,212 B2 * 8/2010 Lukasiewicz et al. ..... 473/332
2004/0067800 A1 4/2004 Kawano
2005/0130757 A1 6/2005 Tucker, Sr.
2006/0223649 A1 * 10/2006 Rife ..... 473/334
2006/0240905 A1 * 10/2006 Haney et al. ..... 473/313
2007/0021236 A1 1/2007 Tucker, Sr. et al.
2007/0298904 A1 * 12/2007 Dworzan ..... 473/340
2008/0045354 A1 * 2/2008 Drew ..... 473/337
2008/0119304 A1 * 5/2008 Chorne ..... 473/340
2008/0139335 A1 * 6/2008 Tavares et al. ..... 473/332
2010/0190566 A1 * 7/2010 Haack et al. ..... 473/252
2010/0331104 A1 * 12/2010 Renna ..... 473/340

* cited by examiner

GOLF CLUB WITH INTERCHANGEABLE FACES AND WEIGHTS

BACKGROUND

1. Field of the Invention

The present invention relates generally to golf clubs and, more particularly, to a golf putter having replaceable striking surface attachments and replaceable weights, and a method for replacing such attachments and weights.

2. Background of the Invention

Most golfers recognize that putting with accurate direction and distance requires a club that communicates a precise sense of touch and feel. The desire to maximize this precise touch and feel and to accurately control the direction of the ball has spawned literally hundreds of golf putter designs. Examples of these various designs include increased putter head mass to accommodate short backswings and lengthen ball travel, balanced putter head mass to improve directional accuracy, decreased putter head mass to increase accuracy, and special putter face striking surfaces that impart a heightened sense of feel and touch in controlling the rebound characteristics of the ball. In terms of design, the present application is directed to interchanging putter face striking surfaces and to adjusting putter head mass.

Golfers typically favor customized golf clubs that enhance, improve, or correct their particular style of play. For manufacturers, this customizing presents a significant challenge, especially when attempting to sell golf clubs to the mass market at competitive prices. With putters, manufacturers have experimented extensively with offering varieties of putter striking surfaces to accommodate personal preferences for club feel and touch. Thus far, manufacturers have offered two principal ways to purchase customized golf putters: 1) one-time customization, in which the manufacturer typically offers a full line of putters with basic designs, but with a variety of striking surfaces designed to appeal to diverse tastes; and 2) adjustable customization, in which a manufacturer typically offers a multi-component putter with a putter head that accepts a variety of interchangeable striking surface attachments, each suitable for different playing styles or playing conditions. The ultimate goal of each of these customization methods is to give the golfer a specialized feel and control that will persuade the golfer to purchase the customized putter instead of a non-customized putter.

In addition to appealing to golfers' desire for customized clubs, some putters attempt to conform to United States Golf Association (USGA) rules to be acceptable for USGA sanctioned play. For customized putters featuring varying striking surfaces or varying attachments, manufacturers desiring USGA conformance must pay particular attention to the USGA rules concerning the attachment of club components and the adjustability of clubs. Specifically, Appendix II.1.a of the USGA rules states that "all parts of the club shall be fixed so that the club is one unit, and it shall have no external attachments except as otherwise permitted by the Rules." Concerning adjustability, Appendix II.1.b.ii of the USGA rules, adopted to accommodate multi-component putters, states that all methods of adjustment require that "all adjustable parts are firmly fixed and there is no reasonable likelihood of them working loose during a round." For one-time customized putters, these rules are typically no obstacle because construction of the club is completed and fixed at the factory, i.e., the club has a fixed face. For adjustable customized putters, however, the multi-components sometimes are not firmly fixed or positively locked and can have a tendency to work loose and/or fail to deliver the feel and performance of firmly fixed components. Further complicating the challenge to manufacturers of adjustable customized putter is the USGA rule interpretation that adjustable components, such as faces, must require the use of a tool to secure the component, thereby lessening the possibilities for more temporary, non-tool adjustments by hand.

Turning to examples of the two types of customized putters, U.S. Pat. No. 5,458,332 to Fisher and U.S. Pat. No. 5,531,439 to Azzarella disclose one-time customized fixed-face golf putter heads having recesses into which inserts are wedged and permanently fitted. In addition, U.S. Pat. No. 5,674,132 to Fisher also discloses an insert wedged into the recess of a golf putter head, but also adds an adhesive layer that securely holds the wedge insert within the recess. In adding this adhesive layer, U.S. Pat. No. 5,674,132 teaches that the adhesive helps to avoid the loosening of the insert by repeated contact of the insert bottom with the ground, during normal usage of the club. However, these one-time customized striking surface putters do not accommodate the desire to fine-tune the putter or to quickly change striking surfaces for varied playing conditions. In other words, if a striking surface is attached to a putter head by a wedged, permanent fit or a wedged fit with adhesive, the striking surface is not quickly removable.

To address this desire to repeatedly change striking surfaces, the adjustable customization designs incorporate multi-component putter heads with replaceable parts, e.g., striking surface inserts or striking surface attachments. Applicant's U.S. Pat. No. 5,332,214 discloses a golf putter that includes a multi-component head having an elastomeric striking surface, a support member for the elastomeric striking surface, a weight, a body member, and screws. The body member includes a recessed area extending substantially across the front of the body member, a central cavity extending through the body member for receiving the weight, and holes through the body member for receiving the screws. The support member includes holes for receiving the screws when the support member is fitted into the recessed area. The elastomeric striking surface is cast or adhesively secured to the support member, together making a striking surface insert.

Applicant's U.S. Pat. No. 6,863,620 discloses a golf putter that includes a variety of replaceable striking surface attachments that allow for positive locking arrangements to quickly change the striking surface attachments.

U.S. Pat. No. 4,121,832 to Ebbing, U.S. Pat. No. 5,690,562 to Sturm, U.S. Pat. No. 5,746,664 to Reynolds, Jr., U.S. Pat. No. 5,839,974 to McAllister, and U.S. Pat. No. 5,921,871 to Fisher all disclose golf putters having an insert fastened to a putter head using threaded screws. Each of these designs uses screws to firmly fix and positively secure the components of the putter head in a manner similar to that taught by applicant's U.S. Pat. No. 5,332,214 and determined by the USGA to be in conformance with its rules. Unfortunately, this use of screws complicates adjusting of the club by requiring tools and frustrates the golfer's ability to quickly fine-tune his putter or to easily adapt the club for varying playing conditions. In the end, golfers typically make a one-time adjustment after the purchase of the club and forgo attempts to customize the club before playing.

In an attempt to simplify adjustable customization, other types of removable insert golf putters teach interference fits in lieu of screws. However, typically the fit is either poorly secured or secured so tightly that further adjustment is impossible. As an example of a poorly secured fit, U.S. Pat. No. 5,542,675 to Micciche et al. discloses an adaptor that snaps onto the putter head, providing an elastomeric striking surface for the putter head. Micciche explains that the putter head adaptor is "adapted to engage" around the putter head, but fails to disclose how the adaptor engages the putter head or how loose or rattling fits, caused by variances in manufacturing such as shrinkage and inconsistent dimensions, are avoided. U.S. Pat. No. 5,620,381 to Spalding discloses a removable putting face insert having a resilient rear wedge portion that is sized and positioned to press fit within a recess of the putter head. However, Spalding specifically teaches that the press fit arrangement is tight enough such that alteration of the club by a golfer is virtually impossible. U.S. Pat. No. 5,718,644 to Donofrio discloses a putter head that can retain an insert by a frictional fit. However, Donofrio specifically contemplates that the insert is permanently attached and impossible to remove, and actually prefers the use of high strength epoxy for the permanent attachment, or alternatively, welding, brazing, bolts, screws, integral latches, or other mechanical fasteners. Thus, if a striking surface is attached to a putter head using high strength epoxy, welding, brazing, bolts, screws, or integral latches as a permanent attachment, the striking surface is not quickly removable.

In another attempt at adjustable customization, U.S. Pat. Nos. 5,690,561 and 5,688,190 to Rowland et al. disclose the removable application of textured adhesive backed pads to a club face. However, the use of temporary adhesive will over time fail to provide a positive lock as the effectiveness of the adhesive deteriorates with use.

Thus, conventional adjustable customized golf putters fail to satisfy golfers' preferences for easily customizing or fine-tuning the putter to adapt to changing playing styles or changing playing conditions.

Although simplifying adjustment, the conventional adjustable customized putters that use interference fits or temporary adhesive also fail to positively secure the insert. The interference fits fail, in part, due to the many variables in manufacturing, including shrinkage and process variations that contribute to inconsistent shapes and dimensions. The consequence of this inconsistency is an undesirable looseness. Likewise, the temporary adhesives do not provide a positive lock and, in addition, deteriorate over time.

As used herein, "looseness" means any independent movement of a club component perceptible to a golfer while using the club to strike a ball. Perceptible includes feeling or hearing independent movement. For example, feeling or hearing a rattle is indicative of looseness. Looseness in a putter prevents replication of the feel of a fixed face putter, and prevents even acceptable performance of the putter.

BRIEF SUMMARY OF THE INVENTION

In accordance with an aspect of the present invention, a golf putter is provided that includes a putter head defining a front portion, a bore, and a first threaded portion having a first thread pitch. The golf putter further includes a striking surface attachment attached to the front portion of the putter head, a rear portion of the striking surface attachment having a second threaded portion having a second thread pitch that is different from the first thread pitch. In one embodiment, the front portion of the putter head defines a cavity, a surface of which is magnetic or ferromagnetic, and the striking surface attachment is disposed in the cavity and magnetically attached to the surface. A weighting element is disposed at a rear portion of the putter head and has a third threaded portion matching the first thread pitch. The weighting element is attached to the putter head via the first threaded portion engaging with the third threaded portion, and is configured to be attached to and detached from the putter head manually. A screw fastener is disposed within the weighting element. The screw fastener has a fourth threaded portion matching the second thread pitch, and is configured to pass through the weighting element and the bore of the putter head and to be attached to the striking surface attachment via the second threaded portion engaging with the fourth threaded portion.

According to a further aspect of the present invention, a method is provided for adjusting the weighting and striking face of a golf putter. In the exemplary method, a desired weighting element is attached to a rear portion of a putter head via a first threaded connection having a first thread pitch, and a desired striking surface attachment is attached to a front portion of the putter head, for example, via a magnetic connection. The desired striking surface attachment is secured to the putter head by means of a screw fastener that passes through the weighting element and the putter head, and threadedly engages a rear portion of the striking surface attachment via a second threaded connection having a second thread pitch different from the first thread pitch.

DETAILED DESCRIPTION OF THE INVENTION

Embodiments of the present invention provide an adjustable customized golf club with a replaceable striking surface attachment and a replaceable weight assembly, an integrated attachment means configured to attach the striking surface attachment and the weight assembly, and a method for replacing the striking surface attachment and weight assembly. The representative embodiment of the golf club is a golf putter.

Figure 1:
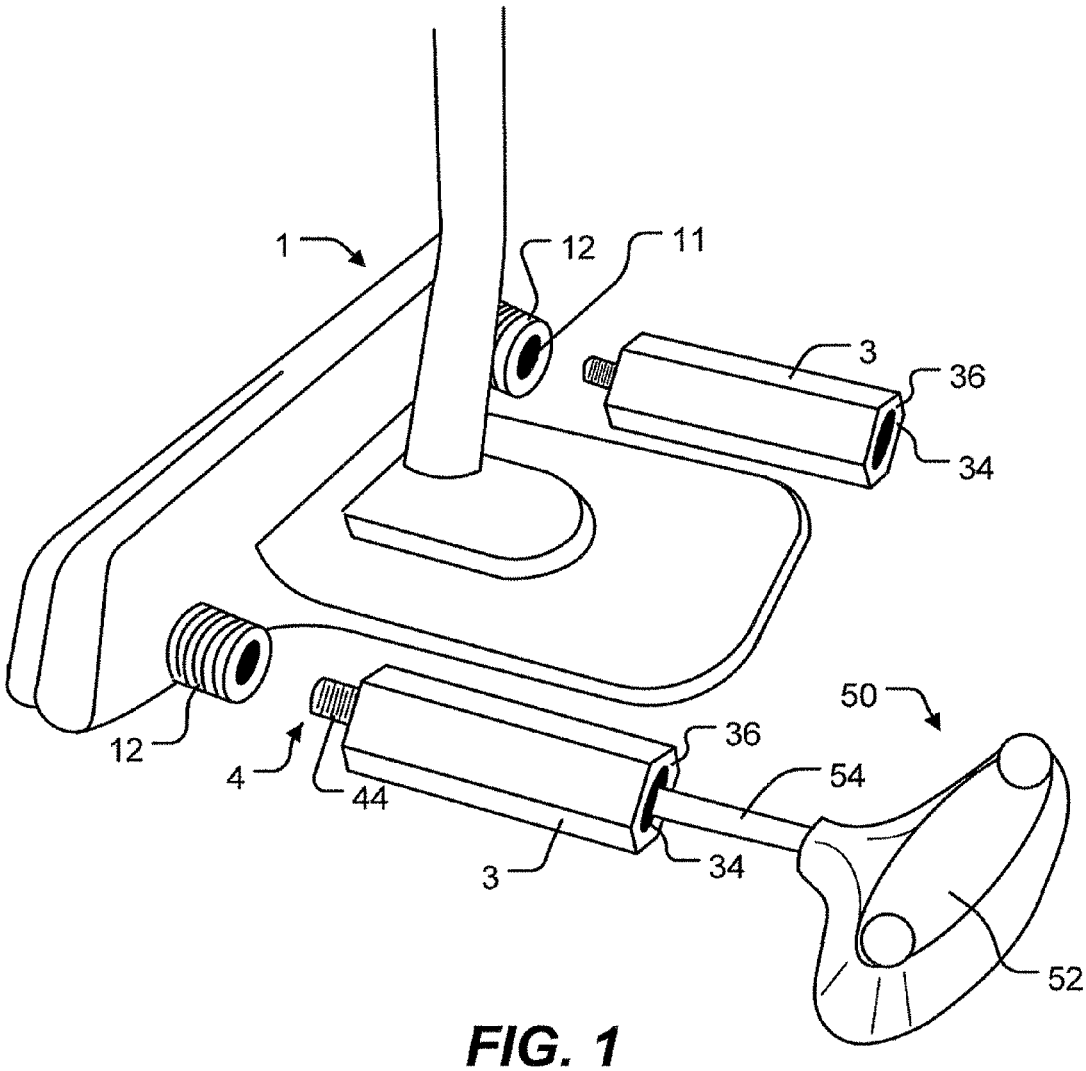
FIG. 1 is a schematic diagram of an exploded perspective view of an adjustable putter in accordance with an embodiment of the present invention.
Figure 2:
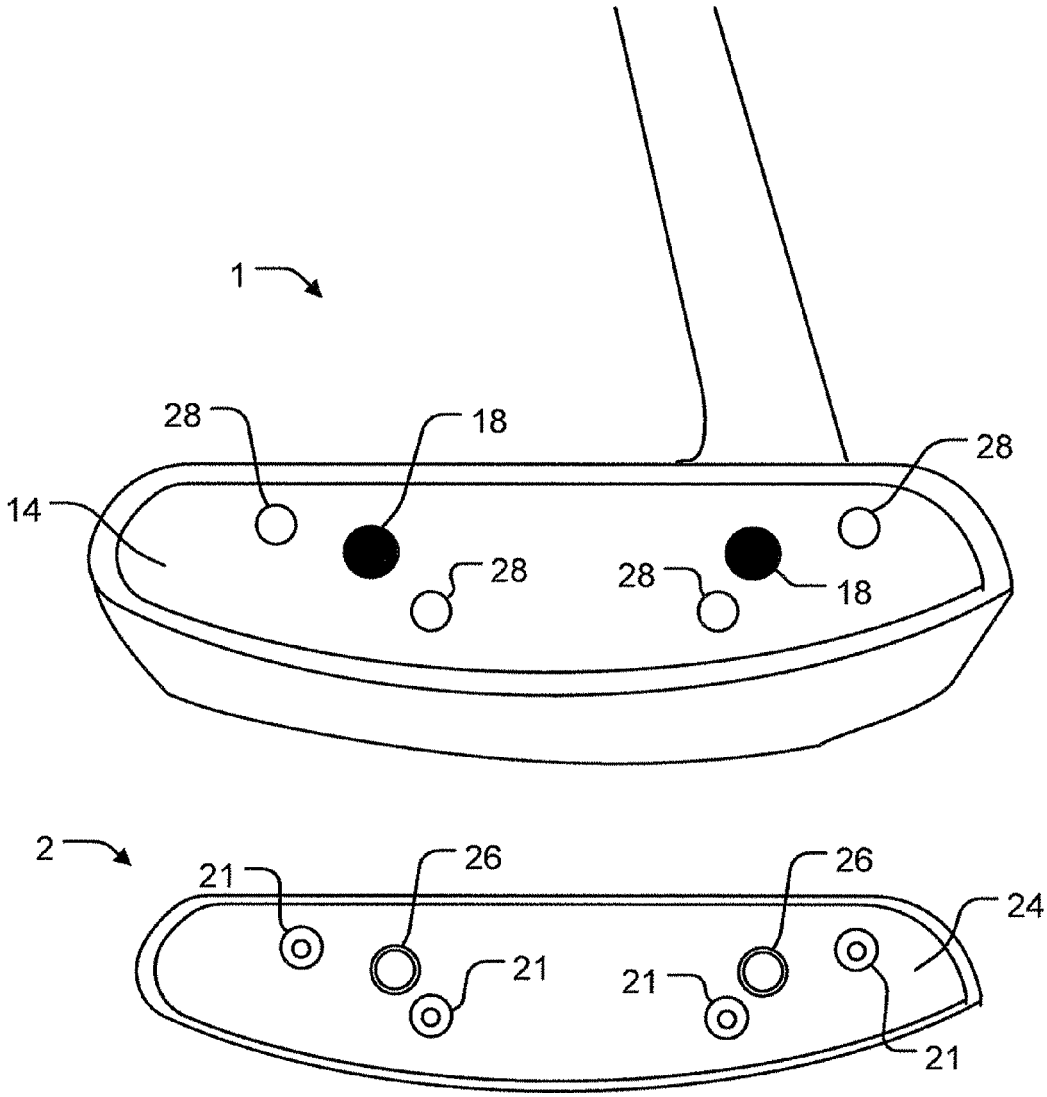
FIG. 2 is a schematic diagram of a putter head and striking surface attachment in accordance with an embodiment of the present invention.

Referring to FIGS. 1 and 2, the present invention, broadly stated, includes a putter head 1, a striking surface attachment 2, and a weight assembly. The configuration of the putter head 1 is designed to match the configuration of striking surface attachment 2 such that the two components fit squarely and tightly together. For example, putter head 1 can have a cavity 14 into which a matching shaped portion of striking surface attachment 2 fits, as shown in FIG. 2. The surface 24 of the striking surface attachment 2 may be formed of a polymer magnet configured to form a magnetic bond with the surface of the cavity 14 of the putter head 1, which may be made of a ferromagnetic material. Alternatively, the surface of the cavity 14 may be formed of a magnetic material and the surface 24 of the striking surface attachment 2 may be formed of a ferromagnetic material. As another alternative, both the surface of the cavity 14 and the surface 24 may be formed of a magnetic material.

The striking surface attachment 2 may be further provided with protrusions 21 that are configured to align with and be seated within indentations 28 located in corresponding locations in the cavity 14 of the putter head 1. The cooperation between these protrusions 21 and indentations 28 helps to consistently and properly locate the striking surface attachment 2 within the putter head cavity 14.

In accordance with a preferred mode of using the present invention, a player may sequentially attach one or more different striking surface attachments 2, each having different characteristics, such as feel, weight, texture, elasticity, etc., during a practice or trial mode in order to determine which striking surface attachment 2 to use during play. During this practice or trial mode, the striking surface attachment 2 can be attached to the putter head 1 only by means of the magnetic bond between magnet 24 and the surface of the cavity 14. In this mode, since the attachment is established only by the magnetic bond, the protrusions 21 and indentations 28 are especially advantageous in maintaining a properly aligned secure fit between the striking surface attachment 2 and putter head 1. Further details regarding the preferred mode of operation are provided below.

In alternative embodiments of the invention, for purposes of the trial mode, the striking surface attachment 2 may be attached to the putter head 1 using different attachment means in addition to or in place of the magnetic connection described above. For example, a striking surface attachment could be attached to a putter head by a component that hooks to or onto another component; a component that compresses into or out of another component; a component that stretches around another component; a component that slides into, over, around, or on another component; a component that snaps into, over, around, or on another component; a component that wedges inside or around another component; a component that clips into, over, around, or on another component; a component that rolls into, over, around, or on another component; a component that twists into, over, around, or on another component; a component that swells or expands into or around another component; and a component that grips onto, around, or over another component. In particular, the attachment means could be, for example, a hook and loop fastener; a press-fit adaptor; a flexible rib; a locking pin; spring-loaded bearings; a quick-turn fastener; a cap nut and threaded extension; a spring rod with a catch-and-release mechanism; a spring-loaded catch-and-release; a spring clip; a swell fastener; a spring latch; a flexible strap; a dovetail slot; or a lap joint. Examples of such alternative attachment means are disclosed in U.S. Pat. No. 6,836,620, which is assigned to the assignee of the present invention, and which is herein incorporated by reference in its entirety. Although the embodiments described herein illustrate particular types of attachment means, such as magnetic means, other equivalent types could suffice without departing from the spirit and scope of the present invention. Preferably, to accommodate the trial mode, the attachment means firmly fixes the striking surface attachment to the putter head without looseness as if it were part of a fixed-face putter, while still allowing quick removal and replacement of the striking surface attachment. Preferably, the attachment means enables a player to remove and replacement the striking surface attachment by hand and without the use of tools.

With further reference to FIG. 1, an additional customizing element is utilized in the form of a weight 3. The weight 3 may be configured in the shape of a hexagonal prism so that it may be attached to a threaded stub 12 on a rear face of the putter head 1, as shown in FIG. 1, by hand. One of skill in the art will appreciate that the weight 3 may have any other shape conducive to being attached to the stub 12 by hand, such as, for example, a cylinder, triangular prism, rectangular prism, pentagonal prism, a wing-type shape (e.g., as on a wing-nut), or a free-form shape providing a grip. The threaded stub has a bore 11 passing there through for accommodation of a screw fastener 4, described in greater detail below. The bore 11 is preferably concentric to the threaded portion of the threaded stub 12.

A plurality of weights 3 may be provided, each with different weighting characteristics, which can be differences in, for example, mass, density, length, or the like. Once the weight 3 is attached the putter head 1, a screw 4 may then engage with a striking surface attachment 2 to fix each part of the putter to form a club that complies with the USGA rules requiring fixed parts. A tool 50 is preferably used to secure the screw 4, and for purposes of rule compliance, is preferably necessary to unscrew the screw 4 and remove the weight 3 from the putter head 1.

Figure 3:
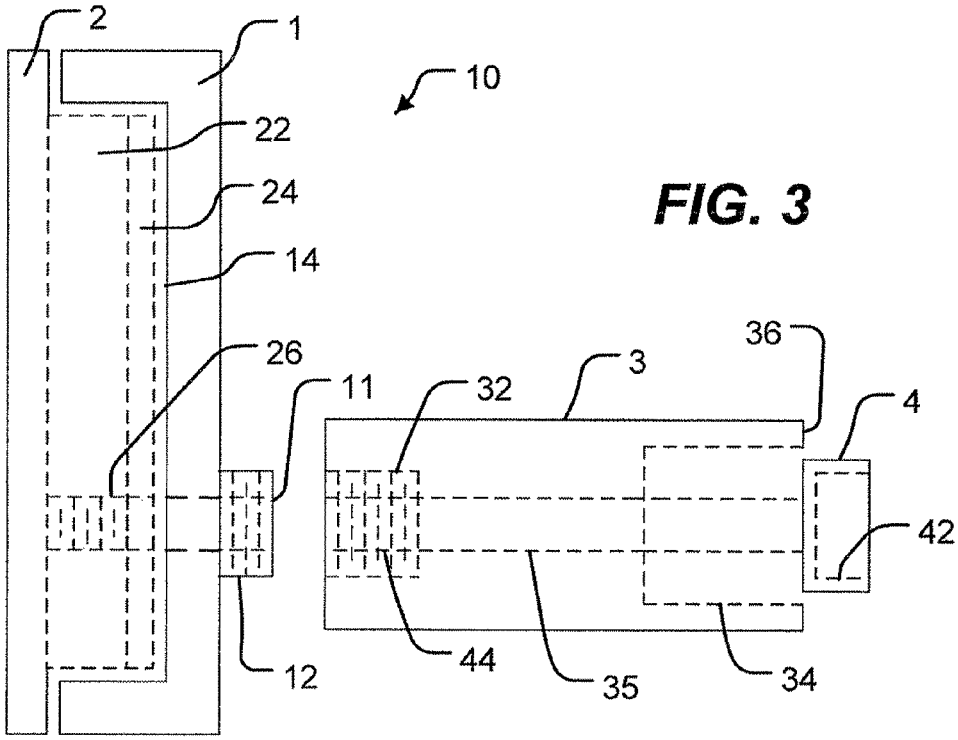
FIG. 3 is a schematic diagram of a cross section of a putter head and weight assembly in accordance with an embodiment of the present invention.

The details of the attachment of the striking surface attachment 2 and the weight 3 are shown in an exemplary arrangement of a golf putter 10 in FIG. 3. Although only a single weight assembly is shown in FIG. 3, one of skill in the art will appreciate that two or more assemblies and putter head attachment parts may be provided in a manner similar to that shown. As shown, the striking surface attachment 2 further comprises an internally threaded bore 26 in a body portion 22 of the attachment 2. The magnet 24 may have a hole therethrough to permit access to the threaded bore 26. The threaded bore 26 may have a thread standard of 10-32 NF or another suitable standard.

The weight 3 may be formed with a set of internal threads 32 at one end that have a size configured to threadedly engage with a threaded stub 12 on a rear side of the putter head 1. As an example, the threaded stub 12 and the internal threads 32 on the weight may have a thread standard of ⅜-24 NF. At the other end of the weight 3, a large bore 34 having a relatively large diameter is formed through a partial length of the weight 3, for example through about a quarter to about a half of the length of the weight 3. A small bore 35 is also formed in the weight 3 and passes from the large bore 34 to the internal threads 32, providing a continuous passage through the length of the weight 3. The weight 3 is attached to the putter head 1 by manually rotating the weight 3 to screw the internal threads 32 onto the external threads of the threaded stub 12. It is preferable that the length of the threaded stub 12 is shorter than the length of the internal threads 32 so that when the weight 3 is screwed down over the threaded stub 12, the end surface of the weight 3 turns tightly against and flush with the rear face of the putter head 1, thereby creating a tight fit.

A socket head screw 4 passes through the small bore 35 of the weight 3. The screw 4 may have any suitable type of socket head 42 such as, for example, hex, double hex, flat, Phillips, star-shaped (Torx™), or the like. The tool 50 has a key part 54 configured to engage with the head 42 of the screw 4. The tool 50 further has a handle part 52 for convenient manipulation. The tool could, of course, take other shapes, sizes, and configurations depending upon the particular screw 4 and socket head 42 that is used; for example, the tool could be a hex key or Allen Wrench™ compatible with a hexagonal socket. The screw 4 may have a threaded portion 44 at one end thereof for threaded engagement with the threaded bore 26 of the striking surface attachment 2. The threaded portion 44 therefore has a thread standard matching that of the threaded bore 26, which may be, for example, 10-32 NF.

Accordingly, in use, a player may first select a desired weight 3 and attach it to the putter head 1 by means of the internal threads 32 of the weight 3 and the threaded stub 12 of the putter head 1. Then, the player may practice with a variety of striking surface attachments 2 to determine one that is preferred. The player may also attach weights 3 of different mass during this time, for example, to experiment with different weight and striking surface attachment combinations. During this practice or trial period, in one embodiment of the invention the striking surface attachments 2 may only be attached to the putter head 1 by means of the magnetic surface 24, or other attachment means suitable for the trial mode, as described above. Once a desired striking surface attachment 2 is selected, the screw 4 may then be tightened to engage with the striking surface attachment 2 by means of the threaded screw portion 44 and the threaded bore 26 of the striking surface attachment 2. At this point, the golf putter is equipped with a desired weight 3 and a desired striking surface attachment 2 in a secure manner, thereby complying with the USGA rules. In addition, the present invention provides the unique advantage that only a single tool 50 is used to secure and make adjustments to two distinct customization elements, namely, the weight 3 and the striking surface attachment 2.

Figure 4:
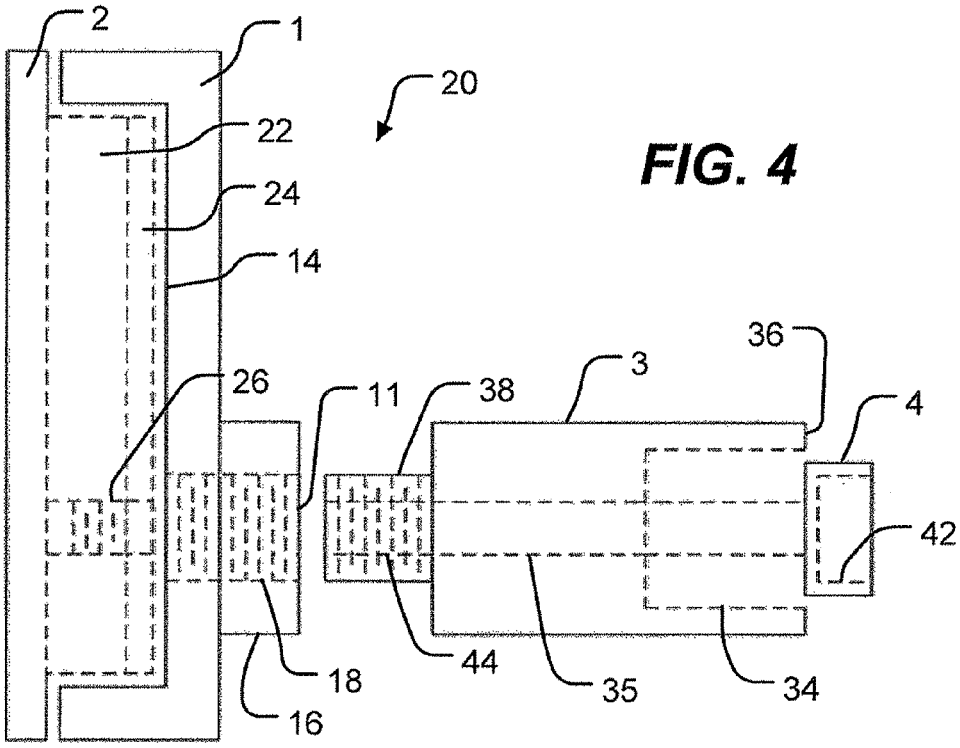
FIG. 4 is a schematic diagram of a cross section of a putter head and weight assembly in accordance with another embodiment of the present invention.

An alternative arrangement of a golf putter 20 is shown in FIG. 4. The golf putter 20 in FIG. 4 is essentially similar to the putter 10 shown in FIG. 3, except that the weight 3 is provided with an externally threaded stub 38 and the putter head 1 is provided with an internally threaded boss 16. The externally threaded stub 38 engages with the internal threads 18 of boss 16. Optionally, the internal threads 18 can continue from the boss 16 into the body of the putter head 1, as shown. It is preferable that the length of the externally threaded stub 38 is shorter than the length of the internal threads 18 so that when the weight 3 is screwed into the threaded boss 16, the end surface of the weight 3 turns tightly against and flush with the rear face of the boss 16, thereby creating a tight fit. In this embodiment, the small bore 35 extends through the threaded stub 38 to allow the screw 4 to pass entirely through the weight 3 and to engage with the threaded bore 26 of the striking surface attachment 2. The operation of the putter 20 is substantially the same as described with respect to the putter 10.

An important aspect of the present invention is the concept that the thread pitch of the threaded connection between the weight 3 and the putter head 1 (referred to as "the first threaded connection" for convenience) is different from, and preferably larger than (i.e., it moves a greater lateral distance per revolution), the thread pitch of the threaded connection between the screw 4 and the striking surface attachment (referred to as "the second threaded connection" for convenience). In the examples provided herein, the first threaded connection is a ⅜-24 NF standard having a pitch of 24 threads per inch, and the second threaded connection is a 10-32 NF standard having a pitch of 32 threads per inch. In this manner, it can be seen that once the screw 4 has been tightened by threadedly engaging with the striking surface attachment 2, the weight 3 will not be able to be removed because any rotation will cause it to bind against the screw head 42 due to the larger pitch. Because of the greater travel distance per revolution of the weight 3 as compared to the screw 4, the weight 3 is locked and prevented from further rotation. Only by using the tool 50 will a player be able to remove the screw 4, and subsequently the weight 3 by hand. One of skill in the art will appreciate that the specific thread standards provided herein are only exemplary and that any suitable pair of disparate pitches may be used to further the intent of the present invention.

According to an embodiment of the present invention, the screw 4 is captively held by the weight 3 such that an integral weight assembly is formed by the weight 3 and the screw 4. Such an arrangement may provide significant advantages in that there are fewer separate parts and consequently a golf player does not have to keep track of both the weights 3 and the screws 4. The present invention contemplates that, in a set of differently configured weights 3, each weight 3 would have its own screw 4 captively held therein for attachment to the putter head 1.

Figure 5:
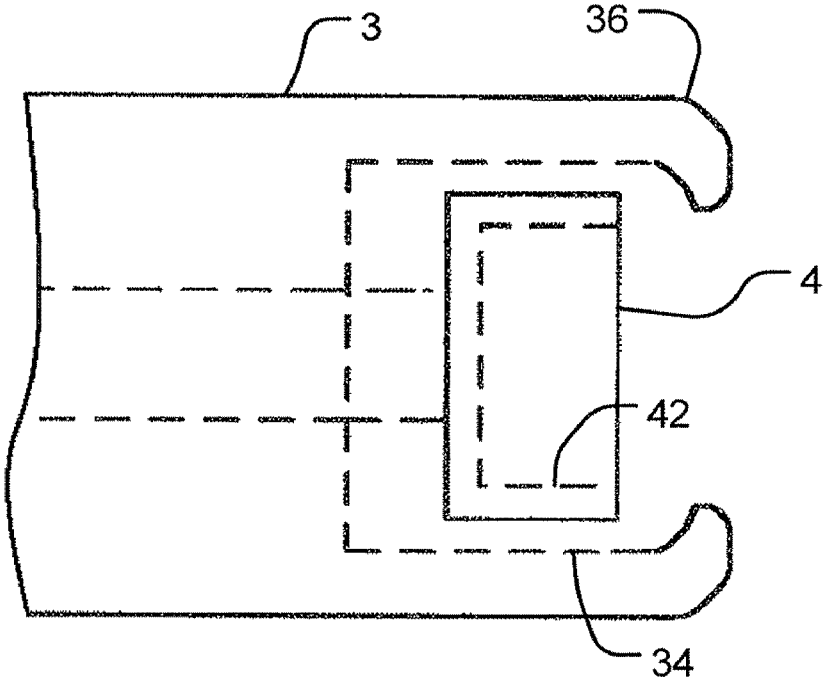
FIG. 5 is a schematic diagram of a cross sectional detail view of a weight assembly in accordance with an embodiment of the present invention.

One way in which the screw 4 may be captively held by the weight 3 is shown in FIG. 5. As shown, once the screw 4 is inserted into the bore 35 of the weight 3, the end surface 36 of the weight may be mechanically bent or deformed to enclose the screw and retain it within the weight 3 while leaving enough of a space for the tool 50 to be inserted and tighten the screw 4. For example, the end surface 36 may be peened with a hammer or otherwise pressed to effectively decrease the size of the opening of the large bore 34. Alternatively, a retaining device (not shown), such as a washer, may be secured to the end surface 36 by welding, gluing, or snap-fit to similarly reduce the size of the opening to the bore 34 while allowing passage of the key part 54 of the tool 50.

A biasing or cushioning member may be provided within the large bore 34 in order to reduce negative effects that may occur due to the looseness of the screw 4 when the player has attached the weight 3 and the striking surface attachment 2 is only secured by the magnetic surface 24 (i.e., the striking surface attachment 2 has not yet been secured to the screw 4). For example, the screw 4 in such a configuration may move back and forth when the player is practicing or trying to determine which striking surface to use, causing unwanted rattling or other movement. A biasing member such as a spring may be inserted into the large bore 34 to maintain a force against the screw 4 so that it does not easily move back and forth when a player swings the putter.

Figure 6:
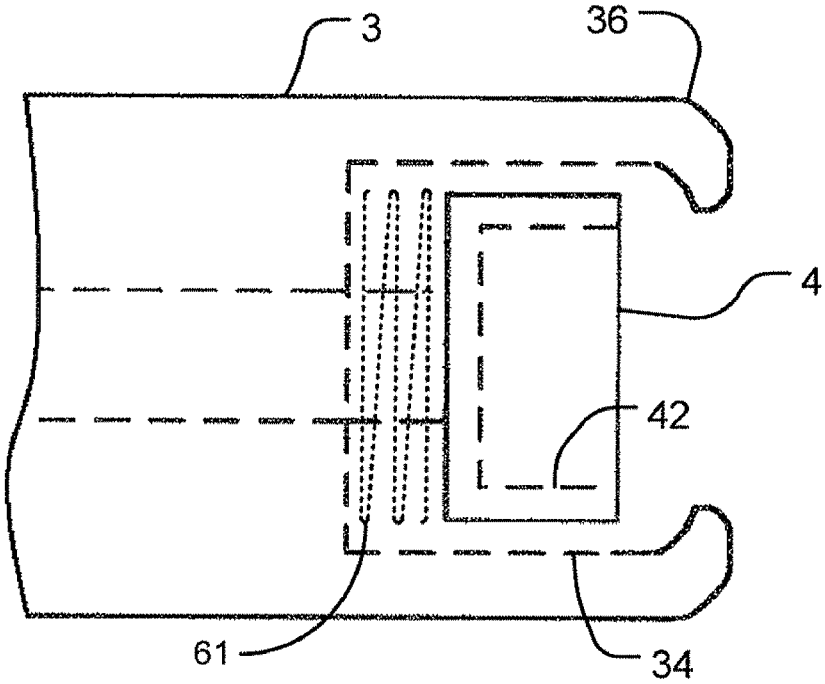
FIG. 6 is a schematic diagram of the weight assembly of FIG. 5, with a spring added between the underside of the screw head and an opposing surface of the bore of the weight, in accordance with another embodiment of the present invention

According to one embodiment, FIG. 6 illustrates an exemplary spring 61 provided between the underside of the head 42 and an opposing interior surface of the bore 34. In this illustration, the spring 61 is partially compressed, which would occur as the screw fastener 4 is advanced toward the end of the weight 3 that connects with a putter head. Before that advancement, however, the spring 61 could expand to press the head 42 in the opposite direction of advancement and up against the inside face of the bore 34, to keep the screw fastener 4 from rattling inside the bore 34.

Alternatively, a cushioning member may be inserted in the large bore 34 to reduce any tangible effects of the movement of the screw 4. As another alternative, a gasket or some other friction-fit device, which may be made of rubber or similar material, may be inserted into the large bore 34. An annular gasket, for example, may allow the screw 4 to pass through a tight-fitting center hole of the gasket that reduces unwanted axial movement of the screw 4, thereby reducing negative effects felt by the player. In addition, the head 42 of the screw 4 itself may be sized appropriately to provide a friction fit against the interior surface of the bore 34.

In another embodiment of the invention, a longitudinal opening in the weight 3, through which the screw fastener 4 passes, could be internally threaded to secure the screw fastener 4 against rattling. For example, referring to FIGS. 3 and 4, the small bore 35 formed in the weight 3 could be internally threaded. In this manner, screw fastener 4 would first be screwed into small bore 35 and held in place temporarily, and then when securing of the striking surface attachment 2 is desired, would be further screwed into the internally threaded bore 26 in the striking surface attachment 2.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A golf putter comprising:

a putter head defining a front portion, a rear portion, a threaded stub protruding from said rear portion, a bore passing through said putter head and said threaded stub, a surface of said threaded stub being defined by a first threaded portion having a first thread pitch;

a striking surface attachment attached to the front portion of the putter head, a rear portion of the striking surface attachment having a second threaded portion having a second thread pitch, the second thread pitch being different from the first thread pitch;

a weighting element disposed at a rear portion of the putter head, the weighting element having a third threaded portion matching the first thread pitch, the weighting element attached to the putter head via the first threaded portion engaging with the third threaded portion, the weighting element being attachable to and detachable from the putter head manually; and a screw fastener disposed within the weighting element, the screw fastener having a fourth threaded portion matching the second thread pitch, the screw fastener passing freely through the weighting element and the bore of the putter head and attached to the striking surface attachment via the second threaded portion engaging with the fourth threaded portion, the screw fastener when engaged securing both the striking surface attachment and the weighting element to the putter head.

2. The golf putter of claim 1, wherein said first threaded portion is an internal surface of said bore passing through said stub of the putter head.

3. The golf putter of claim 1, wherein said first threaded portion comprises an external surface of said stub, and the bore passing through the putter head has a diameter smaller than the first threaded portion, and wherein the bore is concentric to the first threaded portion.

4. The golf putter of claim 1, wherein the screw fastener is captively held by the weighting element.

5. The golf putter of claim 4, wherein an outer portion of the weighting element is mechanically deformed to captively hold the screw fastener within the weighting element.

6. The golf putter of claim 4, wherein a retaining element is attached to an outer portion of the weighting element in order to captively hold the screw fastener within the weighting element.

7. The golf putter of claim 1, wherein the front portion of the putter head defines a cavity, and wherein the striking surface attachment is disposed in the cavity and magnetically attached thereto.

8. The golf putter of claim 1, wherein the striking surface attachment comprises protrusions and the front portion of the putter head comprises indentations, and wherein the protrusions and indentations are configured to consistently align the striking surface attachment with the putter head.

9. The golf putter of claim 1, wherein the first thread pitch comprises fewer threads per inch than does the second thread pitch.

10. The golf putter of claim 1, wherein the screw fastener is a socket head screw that requires the use of a tool to affix the screw fastener to the striking surface attachment.

11. The golf putter of claim 1, further comprising a biasing or cushioning member configured to resist free movement of the screw fastener when the screw fastener is not attached to the striking surface attachment.

* * * * *